US009185479B2

(12) United States Patent
Koch et al.

(10) Patent No.: US 9,185,479 B2
(45) Date of Patent: Nov. 10, 2015

(54) MICROPHONE MODULE AND MICROPHONE SYSTEM HAVING THE MICROPHONE MODULE

(75) Inventors: Hartwig Koch, Hildesheim (DE); Holger Kiehne, Peine (DE); Florian Klingler, Munich (DE); Frank Hofmann, Hildesheim (DE); Gerald Spreitz, Laatzen (DE); Sascha Jakoblew, Hildesheim (DE); Radu Circa, Hildesheim, DE (US)

(73) Assignee: Robert Bosch GmbH, Stuttgart (DE)

( * ) Notice: Subject to any disclaimer, the term of this patent is extended or adjusted under 35 U.S.C. 154(b) by 694 days.

(21) Appl. No.: 13/508,568

(22) PCT Filed: Sep. 22, 2010

(86) PCT No.: PCT/EP2010/063949

§ 371 (c)(1),
(2), (4) Date: Jun. 28, 2012

(87) PCT Pub. No.: WO2011/054594

PCT Pub. Date: May 12, 2011

(65) Prior Publication Data

US 2012/0263314 A1 Oct. 18, 2012

(30) Foreign Application Priority Data

Nov. 9, 2009 (DE) ..... 10 2009 052 297

(51) Int. Cl.
*H04R 27/00* (2006.01)
*H04R 1/04* (2006.01)

(52) U.S. Cl.
CPC ..... *H04R 1/04* (2013.01); *H04R 2420/07* (2013.01)

(58) Field of Classification Search
CPC ..... H04R 1/04
USPC ..... 381/77
See application file for complete search history.

(56) References Cited

U.S. PATENT DOCUMENTS

2002/0042282 A1* 4/2002 Haupt ..... 455/509
2002/0068530 A1* 6/2002 Li ..... 455/82

(Continued)

FOREIGN PATENT DOCUMENTS

CN 1444417 9/2003
DE 10035824 2/2002

(Continued)

OTHER PUBLICATIONS

PCT/EP2010/063949 International Search Report and Written Opinion dated Dec. 17, 2010 (4 pages).

*Primary Examiner* — Sonia Gay
(74) *Attorney, Agent, or Firm* — Michael Best & Friedrich LLP

(57) ABSTRACT

Microphone systems having wireless microphones are often used in events such as discussions, concerts, plays, etc. and normally have a plurality of wireless microphones which are worn by users, such as actors, musicians, singers, etc, and one or more receiving stations which receive the audio signals of the wireless microphones and forward said signals to mixing consoles, amplification systems, recording devices, etc. In addition to the basic functionality of transmitting audio signals, microphone systems have become known which implement additional functions. The invention relates to a microphone module 2 having a transmitting unit 6 wherein the transmitting unit 6 is designed for the wireless transmission of audio information to a base station 3, having a receiving unit 8, wherein the receiving unit 8 is designed to receive wirelessly transmitted status information and/or messages from a transmitter 4, 12 and having an output device 13, 14 for the output of the status information and/or messages to a user of the microphone module 2.

17 Claims, 2 Drawing Sheets

(56) References Cited

U.S. PATENT DOCUMENTS

| | | | | |
|---|---|---|---|---|
| 2005/0186936 | A1* | 8/2005 | Shih | 455/404.1 |
| 2006/0217162 | A1 | 9/2006 | Bodley et al. | |
| 2009/0052713 | A1* | 2/2009 | Abe | 381/355 |
| 2010/0119099 | A1 | 5/2010 | Haupt et al. | |

FOREIGN PATENT DOCUMENTS

| | | |
|---|---|---|
| DE | 202006002942 | 7/2007 |
| EP | 1936929 | 6/2008 |
| WO | 2007052269 | 5/2007 |

* cited by examiner

MICROPHONE MODULE AND MICROPHONE SYSTEM HAVING THE MICROPHONE MODULE

BACKGROUND

The invention relates to a microphone module having a transmitting unit, wherein the transmitting unit is designed for the wireless transmission of audio information to a base station, and having a receiving unit, wherein the receiving unit is designed for receiving wirelessly transmitted status information and/or messages from a transmitter. The invention also relates to a microphone system having the microphone module.

Microphone systems having wireless microphones are often used in events such as discussions, concerts, plays, etc. and normally have a plurality of wireless microphones which are worn by users such as actors, musicians, singers, etc., and one or more receiving stations which receive the audio signals of the wireless microphones and forward these signals to mixing consoles, amplification systems, recording devices, etc. In addition to the basic functionality of transmitting audio signals, microphone systems have become known which implement additional functions:

In the printed document CN 1444417 A, a karaoke microphone is presented which has a screen on which the text of a song to be sung can be displayed. The text is recorded on the microphone before the event, during the event, the user can scroll the text of the song forward with the aid of buttons or change to another song.

Printed document DE 100 35 824 A1, in contrast, relates to a system having a plurality of wireless transmitting units which can also be designed as microphones, and a central receiving unit, wherein the transmitting unit and the receiving unit are connected, on the one hand, via a channel for transmitting audio information and, on the other hand, via a bidirectional channel which provides for the exchange of technical information and thus a technical calibration between the transmitting unit and the receiving unit. This printed document may well form the nearest prior art.

SUMMARY

The microphone module comprises a microphone for picking up audio signals and/or can be connected to this microphone, for example via a cable-connected or cableless interface. The microphone module is preferably designed to be portable or mobile. Especially, the microphone module is adapted to the use in a discussion, on the stage and/or for a presenter.

The microphone module comprises a transmitting unit which is designed for the wireless transmission of audio information to a base station. The wireless transmission takes place preferably in transmitting frequencies within the VHF/UHF range. In particular, the transmission of the audio information take place as a digital transmission. The transmitting power of the transmitting unit is preferably designed for being able to transmit the audio information to the base station via a distance of more than 5 meters, preferably more than 10 meters and especially more than 15 meters.

The microphone module also comprises a receiving unit, wherein the receiving unit is designed for receiving wirelessly transmitted status information and/or messages from a transmitter. By means of the receiving unit, a return channel is thus established which allows a data flow in the direction of the microphone module.

According to the invention, an output device is proposed as component of the microphone module which is designed for outputting the transmitted status information and/or messages to a user of the microphone module. By means of this supplement, the microphone module is designed for receiving current and/or online data from the transmitter which are directed to the user of the microphone module as addressee.

Whilst only the feedback of technical configuration parameters via return channels has been known in the previous prior art, the functionality of the microphone module is explained according to the invention in that status information and/or messages can be conveyed and made known to the user of the microphone module via the return channel. The advantage of the invention can be seen, in particular, in that the selective distribution of information is possible even during an event, e.g. on a stage. It is especially in large events that the invention helps to avoid errors during the event. Hitherto, the users had to respond, e.g. to stage directions which were given by eye contact, hand signals or, in the worse case, orally and which could also lead to misunderstandings. By means of the wireless distribution of such and other directions as messages or of other status information via the mobile microphone modules, the users can be addressed directly, selectively and thus unmistakably.

In a preferred development of the invention, the status information comprises a course and/or status of the event. For example, a countdown signal to when the microphone module goes on line, that is to say On Air, can be transmitted or indicted as status information. For example, the remaining time left in an event can also be indicated as countdown signal or the expected time of the end of an event. Other status information can be designed as the quality of transmission of the audio information from the transmitting unit to the base station. By means of an output of the quality of transmission on the output device, the use can recognize, e.g. whether he has moved too far away from the base station. It is also possible that a user ID which represents the role or a pseudonym for a user profile for the microphone module is transmitted as status information. For example, "backing vocal" or "lead vocal" can be indicated as user ID. By this means the user can check whether he has received the correct microphone module. This makes it possible to avoid confusions, particularly in the case of large events comprising many microphone modules. The status information can also comprise an amplifier status wherein it is indicated whether the microphone module is currently switched to transmission or to the loudspeakers or is in a "mute" state.

In one possible embodiment of the invention, the messages comprise, for example, technical messages to the user. It is also possible that the messages comprise instructions to the user, especially stage directions which are transmitted especially preferably in text form. It is also possible to implement a teleprompter function wherein a text to be spoken is transmitted as message.

In one preferred embodiment of the invention, the output device has a screen on which the status information and/or the messages can be displayed. The screen thus forms the interface between the microphone module and the user. As an alternative or additionally, other display elements such as, for example, LEDs, rows of lights etc. can also be arranged on the microphone module.

In one advantageous development of the invention, the output device comprises a vibration alarm device for outputting a status indication of the microphone module, for example similar to a ringing tone. The vibration alarm device can be driven in such a manner that the arrival of new status information and/or messages is unobtrusively pointed out to the user. It is also possible to use the vibration alarm device for outputting status information and/or messages in that these are coded, e.g. similar to a Morse code.

A further subject matter of the invention relates to a microphone system which has at least one microphone module, preferably several microphone modules, as they have previously been described, and which has a transmitter which is designed for conveying the status information and/or the messages in the form of a wireless transmission to the microphone module. The transmitter can be designed as a separate constructional unit which, in particular embodiments, is even implemented to be portable so that, for example, a director can carry it himself. As an alternative, the transmitter is arranged in the base station but can have arbitrary interfaces for wireless or cable-connected remote control so that, e.g., status information and/or messages can be sent to the user from a mixing console.

In one development of the invention, the microphone system comprises at least one repeater which can be arranged at a distance from the transmitter and which is allocated to the transmitter. In its usual definition, the repeater is a unit which receives a signal, in this case the status information and/or messages, then reprocesses and retransmits them. In particular, the repeater is used for extending the range of the transmitter.

It can also be provided that the range of the transmitter having the at least one repeater is designed to be greater than the range of the base station so that in the case of reduced quality of transmission with regard to the transmission of the audio information, the user can be informed via the transmitter or the repeaters, respectively, that he is at risk of leaving, or even already has left the range of reception of the base station.

In one possible development of the invention, the microphone modules can be selectively addressed so that one or more microphone modules can be selected by the transmitter and messages and/or status information can be transmitted individually. In particular, it can be provided that the status information and/or messages are sent at the same time to at least two microphone modules or to a selected group of microphone modules. It is thus possible to send a broadcast message to several or all users of the microphone modules.

A further subject matter of the invention relates to a method which serves the transmission of status information and/or messages to a microphone module. The method is characterized by the fact that the status information and/or messages are transmitted to the microphone in operation, that is to say in parallel with the transmission of the audio information, particularly during an ongoing event.

BRIEF DESCRIPTION OF THE DRAWINGS

Further features, advantages and effects of the invention can be found in the subsequent description of a preferred exemplary embodiment of the invention and in the attached figures in which.

DETAILED DESCRIPTION

Figure 1:
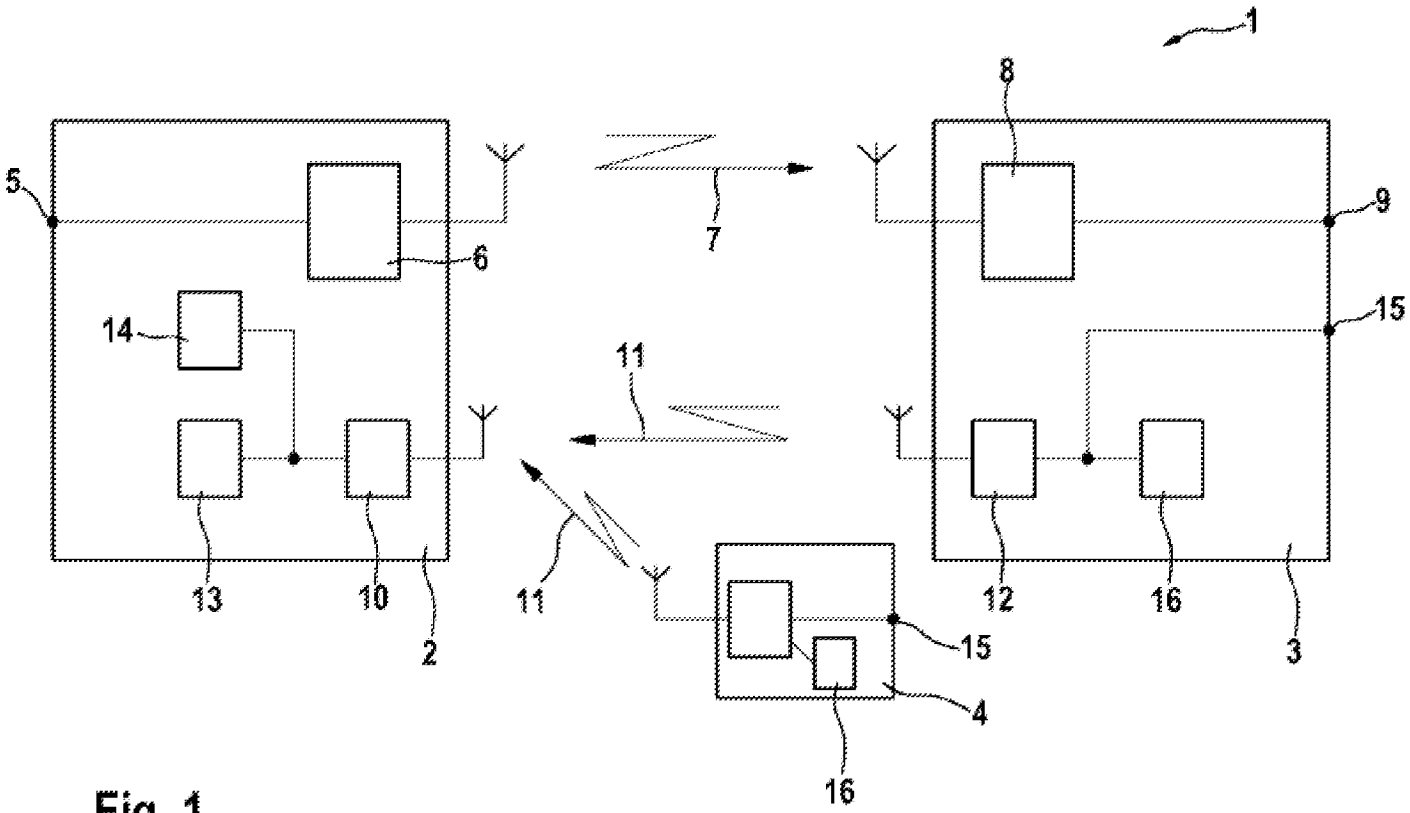
FIG. 1 shows a schematic block diagram of a microphone system as an exemplary embodiment of the invention.

FIG. 1 shows in a highly diagrammatic representation a microphone system 1 which comprises a microphone module 2 and a base station 3. Optionally, an additional transmitter 4 is shown which will still be explained in the text which follows. The microphone module 2 is designed to be portable and, from its purpose of use, is intended to be used, for example, by a presenter, a singer etc.

The microphone module 2 has an integrated microphone (not shown) or at least one interface 5 for linking an external microphone to pick up the singing or the voice or other audio signals. These audio signals are then digitized via a transmitting unit 6, compressed and possibly provided with an error protection and transmitted via a wireless transmission link 7 to the base station 3 where the wirelessly transmitted audio information is processed again in a receiving unit 8 and forwarded, for example at an interface 9, to a mixing console, to an amplifier system etc.

Additionally, the microphone module 2 has a receiving unit 10 for a return channel signal 11 which is also transmitted wirelessly. In this context, the return channel signal 11 can be conveyed optionally by the base station 3 from an internal transmitter 12 or from the external transmitter 4. It is also possible that both the base station 3 with integrated transmitter 12 and additional transmitters 4 are used.

The microphone module 2 has a display device 13 which can be designed, for example, as LCD, TFT display or another type of screen. Optionally additionally, the microphone module 2 comprises other optical, haptic or even acoustic signal devices 14 such as, for example, a vibration alarm, e.g. in order to notify the user of the microphone module 2 of the arrival of data in conjunction with the channel signal 11 or to output these data.

In operation, status information and/or messages from the base station 3 or the transmitter 4 are transmitted to the receiving unit 10 via the return channel signal 11 and output at the output device 13 to the user of the microphone module 2. By means of this extension, it is possible that messages and/or status information is conveyed to the user during the operation or during an event. The signal device 14 can be used, for example, as notification signal that new status information or a new message is present at the display device 13. It is also possible that information such as, for example, an action signal, is output directly by the signal device 14.

The messages or the status information, respectively, are input optionally via an interface 15 in the base station 3 or in the transmitter 4, respectively, which can be coupled, for example, to a mixing console so that predefined messages can be sent from the mixing console via a transmitter 4 or 12 as return channel signal 11 to the microphone module 2. As an alternative or additionally, operating elements 16 are provided at the base station 3 or at the transmitter 4, respectively, which provide for a direct activation of, e.g., predefined status information and/or messages.

Among other things, the following data are possible as possible status information and/or messages: signal quality/transmission quality; countdown signals; status: "On air"/"mute"; artist ID; duration of the concert/clock time.

In the case where several base stations 3 and/or several microphone modules 2 are used in a microphone system 1, each microphone module 2 has an identification option so that each microphone module 2 can be addressed selectively and individually by the base station 3. In this case, it is possible even in the case of large events to convey status information and/or messages selectively to each microphone module 2 in order to inform certain users individually and selectively. However, it is also possible that a plurality of microphone modules 2 receive a status information item and/or a message at the same time in the sense of a broadcast. This is appropriate, for example, when an entire group of users is to be supplied with stage directions.

Figure 2:
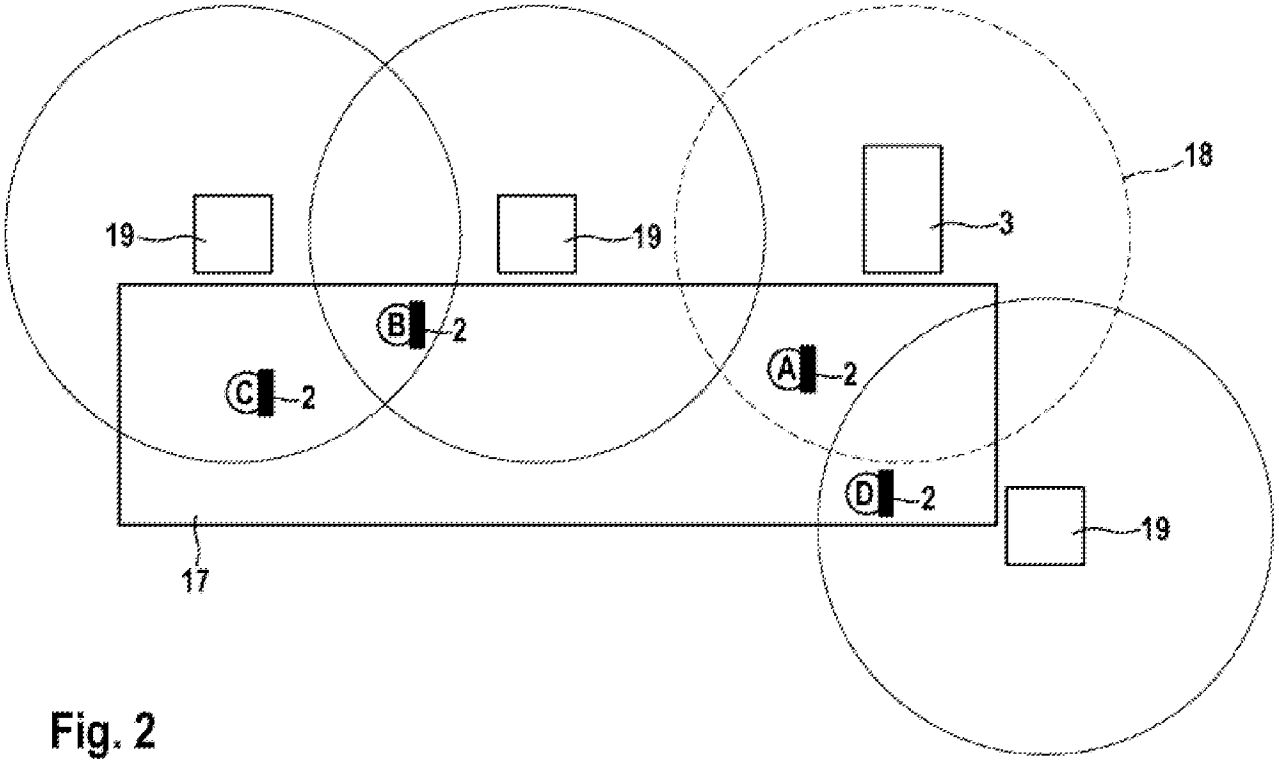
FIG. 2 shows a highly diagrammatic top view of a stage as illustration of an extension of the microphone system in FIG. 1.

FIG. 2 shows a diagrammatic top view of stage 17 on which a microphone module 2 is shown at various positions A, B, C, D. The base station 3 is additionally provided with a circle 18 which is intended to represent both the range of the receiving unit 8 and the range of the integrated transmitter 12.

As soon as the actor having the microphone module 2 at position A leaves the circle 18, neither audio information from the microphone module 2 can be transmitted to the base station 3 nor messages and/or status information in the opposite direction. To ensure at least a transmission of the messages and/or status information, the microphone system 1 is supplemented by a plurality of repeaters 19 which repeat the messages and/or status information. Due to the local distribution of the repeaters 19, remote areas of the stage 17 are also covered so that at least messages and/or status information and especially the notification that the quality of transmission is inadequate due to the circle 18 having been left can be indicated on the microphone module 2 at positions B, C, D.

If the transmission of the return channel signal 11 has a greater range than the transmission link 7, a warning can be triggered, e.g. by the microphone module 2 or by the base station 3, when the microphone module 2 leaves the area of range of the transmission link 7. A greater range of the return channel signal 11 is possible since this transmission needs a lower data rate than the transmission link 7.

The invention claimed is:

1. A microphone module (2) having a transmitting unit (6), wherein the transmitting unit (6) is designed for the wireless transmission of audio information to a base station (3), having a receiving unit (8), wherein the receiving unit (8) is designed for receiving wirelessly transmitted data from a transmitter (4, 12), characterized by an output device (13, 14) of the microphone module (2) for outputting the data to a user of the microphone module (2); wherein the data is a message comprising at least one of technical messages to a user, instructions to the user, and teleprompter messages.

2. The microphone module (2) as claimed in claim 1, characterized in that the data is status information comprising at least one of a course of the event, a quality of transmission of audio information, a user ID and an amplifier status.

3. The microphone module (2) as claimed in claim 1, characterized in that the output device (13) comprises a screen on which the data is displayed.

4. The microphone module (2) as claimed in claim 1, characterized in that the output device (14) comprises a vibration alarm device.

5. A microphone system (1) having at least one microphone module (2) as claimed in claim 1, characterized by the transmitter (4, 12), wherein the transmitter (4, 12) is designed for conveying data wirelessly to the microphone module (2).

6. The microphone system (1) as claimed in claim 5, characterized in that the transmitter (4) is arranged in the base station (3).

7. The microphone system (1) as claimed in claim 5, characterized by at least one repeater (19) arranged at a distance from the transmitter (4, 12) and which is allocated to the transmitter.

8. The microphone system (1) as claimed in claim 5, characterized by a plurality of microphone modules (2), wherein the data is sent simultaneously to at least two microphone modules (2).

9. The microphone system (1) as claimed in claim 8, characterized in that the microphone modules (2), is configured to be addressed and/or contacted selectively.

10. A method for transmitting data by a microphone module (2) as claimed in claim 1, characterized in that the data is transmitted to the microphone module (2) during operation.

11. The microphone module (2) as claimed in claim 1, wherein the data is status information.

12. The microphone module (2) as claimed in claim 1, wherein the data is messages.

13. The microphone module (2) as claimed in claim 1, wherein the data is status information and messages.

14. The microphone system (1) as claimed in claim 5, wherein the data is status information.

15. The microphone system (1) as claimed in claim 5, wherein the data is messages.

16. The microphone system (1) as claimed in claim 5, wherein the data is status information and messages.

17. The method for transmitting data as claimed in claim 10, wherein the operating is an ongoing event.

* * * * *